US008325092B2

(12) United States Patent
Lee et al.

(10) Patent No.: US 8,325,092 B2
(45) Date of Patent: Dec. 4, 2012

(54) MICROWAVE ANTENNA

(75) Inventors: Jae Seung Lee, Ann Arbor, MI (US); Paul D. Schmalenberg, Ann Arbor, MI (US); Amin Rida, Atlanta, GA (US); Ronglin Li, Norcross, GA (US); Emmanouil M. Tentzeris, Atlanta, GA (US)

(73) Assignees: Toyota Motor Engineering & Manufacturing North America, Inc., Erlanger, KY (US); Georgia Tech Research Corporation, Atlanta, GA (US)

( * ) Notice: Subject to any disclaimer, the term of this patent is extended or adjusted under 35 U.S.C. 154(b) by 348 days.

(21) Appl. No.: 12/841,664

(22) Filed: Jul. 22, 2010

(65) Prior Publication Data

US 2012/0019414 A1 Jan. 26, 2012

(51) Int. Cl.
*H01Q 1/38* (2006.01)

(52) U.S. Cl. ..... 343/700 MS; 343/824; 343/853

(58) Field of Classification Search ..... 343/700 MS, 343/824, 846, 850, 853
See application file for complete search history.

(56) References Cited

U.S. PATENT DOCUMENTS

| | | | | |
|---|---|---|---|---|
| 4,691,206 | A * | 9/1987 | Shapter et al. | 343/700 MS |
| 4,713,670 | A * | 12/1987 | Makimoto et al. | 343/700 MS |
| 4,963,892 | A * | 10/1990 | Matsuo et al. | 343/700 MS |
| 5,952,973 | A * | 9/1999 | Uematsu et al. | 343/700 MS |
| 6,818,477 | B2 | 11/2004 | Veitschegger et al. | |
| 7,259,642 | B2 | 8/2007 | Kirino | |
| 7,696,930 | B2 | 4/2010 | Akkermans et al. | |
| 7,868,828 | B2 * | 1/2011 | Shi et al. | 343/700 MS |
| 7,889,136 | B2 * | 2/2011 | Mao et al. | 343/700 MS |
| 2007/0176846 | A1 | 8/2007 | Vazquez et al. | |

* cited by examiner

*Primary Examiner* — Hoang V Nguyen
(74) *Attorney, Agent, or Firm* — Gifford, Krass, Sprinkle, Anderson & Citkowski, P.C.

(57) ABSTRACT

A microwave antenna having an electrically nonconductive substrate with a top and bottom side. A radiator array having a plurality of rows of radiator patches is disposed on the top side of the substrate while an input feed line and power divider network are disposed on the bottom side of the substrate. The power divider network includes a plurality of ends wherein each end is adapted for electrical connection through a via formed through the substrate to the end of its associated row in the radiator array. An electrically conductive layer is disposed over a portion of the top side of the substrate so that the electrically conductive layer overlies the power divider network and shields the power divider network from the radiator array.

6 Claims, 1 Drawing Sheet

MICROWAVE ANTENNA

BACKGROUND OF THE INVENTION

I. Field of the Invention

The present invention relates generally to antennas and, more particularly, to microwave antennas.

II. Description of Material Art

There are many previously known microwave antennas, i.e. antennas for emitting electromagnetic radiation in the millimeter wavelength range. For example, a narrow bandwidth around 77 gigahertz is reserved for automotive use.

These previously known microwave antennas typically comprise an electromagnetic radiator array constructed of a plurality of electrically conductive radiator patches disposed on one side of a nonconductive substrate. An input feed line containing the signal is then electrically connected to one end of the array through a power divider network so that typically each row in the radiator array receives the same amount of power from the feed line.

Ideally, each connection in the power divider network forms a perfect impedance match, e.g. 50 ohms. When such a perfect impedance match is obtained in the power divider network, essentially all of the power from the input feed line is electrically coupled to the radiator array.

Unfortunately, the previously known power divider networks for microwave antennas do not achieve a perfect impedance match at each connection in the power divider network since the power divider network necessarily requires curves which alter the impedance of the power divider at each of its connection points. The impedance mismatch in the power divider network, in turn, results in spurious radiation which can cause undesired cross talk or coupling into the main radiator array.

SUMMARY OF THE PRESENT INVENTION

The present invention provides a microwave antenna construction which overcomes the above-mentioned disadvantages of the previously known microwave antennas.

In brief, the microwave antenna of the present invention includes an electrically insulating substrate having a top and bottom side. A radiator array is disposed on the top side of the substrate. This radiator array is conventional in construction and includes a plurality of electrically conductive patches arranged in rows and columns. In operation, each row of the radiator array is electrically coupled to the microwave input signal.

An input feed line is disposed on the second portion of the bottom side of the substrate. This input feed line is coupled to a power divider network having a plurality of outputs which correspond to the number of rows in the radiator array. In order to electrically connect the ends of the divider network to the radiator array, a via is formed through the substrate which electrically connects each end of the power divider network to its associated column in the radiator array.

An electrically conductive layer is then disposed on the top side of the substrate adjacent the radiator array so the electrically conductive portion overlies the feed line as well as the power divider network except for the very ends of the power divider network. This electrically conductive layer is, in turn, electrically connected to a ground plane underlying the radiator array so that the electrically conductive layer and ground plane electrically shield the power divider network from the radiator array thus shielding the radiator array from spurious radiation from the divider network.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
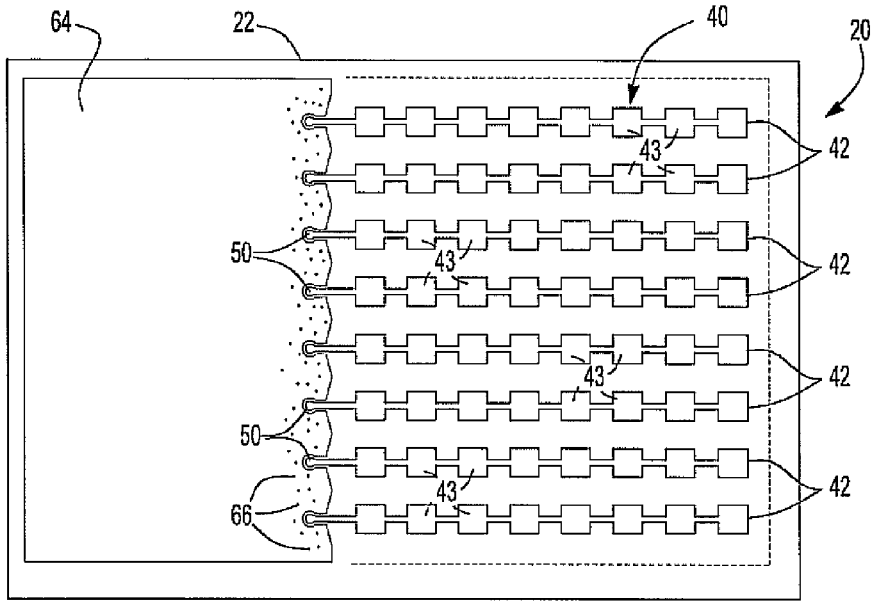
FIG. 1 is a top plan view illustrating a preferred embodiment of the present invention.
Figure 2:
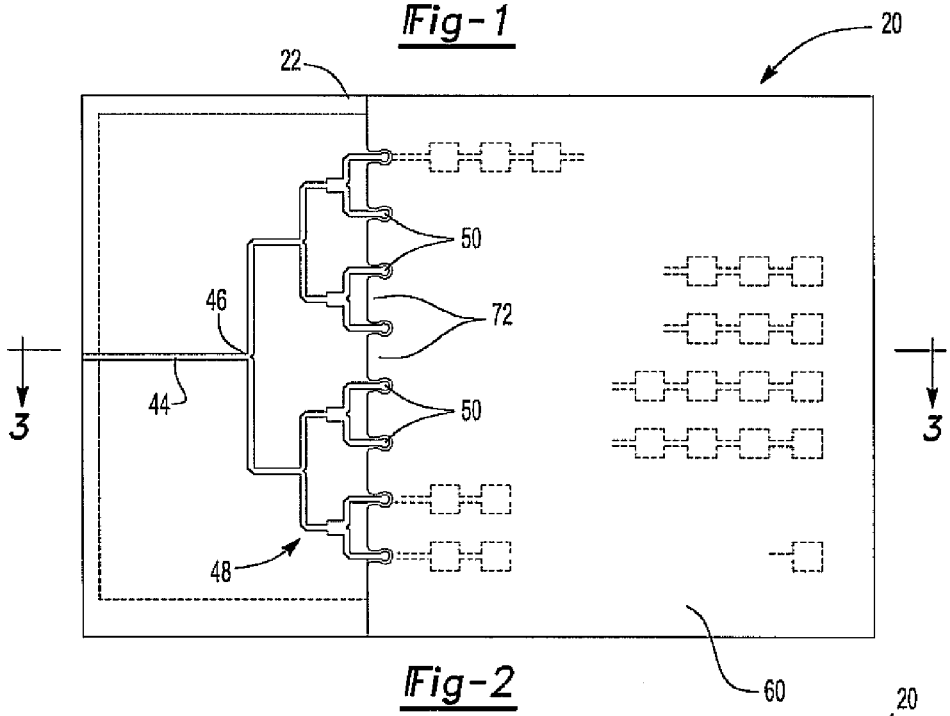
FIG. 2 is a bottom plan view illustrating the preferred embodiment of the present invention.
Figure 3:
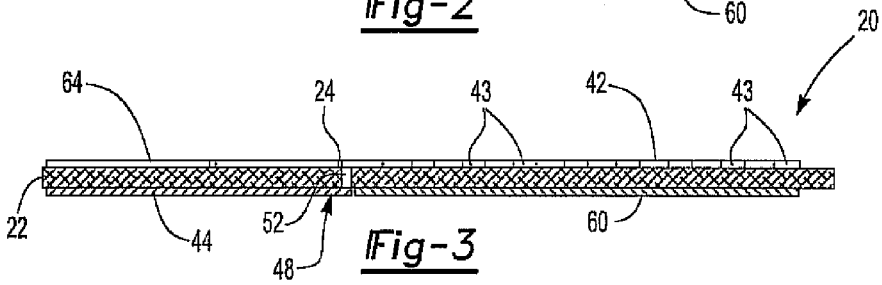
FIG. 3 is a sectional view taken substantially along line 3-3 in FIG. 2.

With reference first to FIGS. 1-3, a preferred embodiment of a microwave antenna 20 according to the present invention is shown. The antenna 20 includes a substrate 22 constructed of an electrically nonconductive or insulating material. As best shown in FIG. 3, the substrate 22 includes a top surface 24 and a bottom surface 26.

As best shown in FIG. 1, a radiator array 40 having a plurality of rows 42 is disposed on the top side 24 of the substrate 22. In the conventional fashion, each row of the radiator array 40 includes a plurality of spaced radiators 43. The radiators 43 are constructed of an electrically conductive material and electrically connected together in each row 43.

As best shown in FIG. 2, an input signal feed line 44 has one end 46 connected to an input of a "one to two" power divider network 48. The power divider network 48 includes a plurality of power output ends 50 so that each end 50 corresponds to one row 42 in the radiator array 40 (FIG. 1). Furthermore, both the input feed line 44 and power divider network 48 are formed on the bottom surface 26 of the substrate 22.

As best shown in FIG. 3, in order to electrically connect the ends 50 of the power divider network 48 to their respective rows 42 of the radiator array 40, an electrically conductive via 52 is formed through the substrate 22 so that each via 52 electrically connects one end 50 of the power divider network 48 to its respective associated row 42 in the radiator array.

Referring now to FIGS. 2 and 3, an electrically conductive ground plane 60 is formed on the substrate 22, preferably on the bottom surface 26, so that the ground plane 60 underlies the radiator array 40. Such a ground plane 60 is conventional in construction and is required for proper radiation from the radiator array 42.

Referring now to FIGS. 1 and 3, an electrically conductive layer 64 is formed on the top surface 24 of the substrate 22 adjacent the radiator array 40. This electrically conductive layer 64 thus overlies not only the input feed line 44, but also all of the power divider network 48 except for the areas immediately surrounding the vias 52. As best shown in FIGS. 1 and 2, the electrically conductive layer 64 includes edge portions 70 which partially surround each via 52 while, similarly, the ground plane 60 includes edge portions 72 which partially surround each via. The electrically conductive layer 64 is then electrically connected to the ground plane 60 (FIGS. 2 and 3) by a plurality of small vias 66 extending through the substrate 22 and connecting the edge portions 70 and 72 of the electrically conductive layer 64 and the ground plane 60, respectively.

In operation, by locating both the input feed line 44 as well as the power divider network 48 to the side of the substrate 22 opposite from the radiator array 40 and then shielding the power divider network 48 and input line 44 from the radiator array 40 by the electrically conductive layer 64, the radiator array 40 is protected from spurious radiations caused by the power divider network 48.

From the foregoing, it can be seen that the present invention provides a simple yet effective microwave antenna which effectively shields the radiator array from spurious radiations caused by the power divider network and input feed line. Having described our invention, however, many modifications thereto will become apparent to those skilled in the art to which it pertains without deviation from the spirit of the invention as defined by the scope of the appended claims.

We claim:

1. A microwave antenna comprising:

a substrate having a top surface and a bottom surface, said substrate being constructed of an electrical insulating material, a radiator array having a plurality of rows disposed on said top surface of said substrate, a signal feed line and power divider network disposed on said bottom surface of said substrate, said signal feed line being coupled to said power divider network, said power divider network having a plurality of connection ends, a plurality of vias formed through said substrate, each via electrically connecting one connection end of said divider network to one of said rows of said radiator array, an electrically conductive layer disposed on said top surface of said substrate so that said layer overlies a portion of said power divider network, said layer being electrically isolated from said radiator array.

2. The microwave antenna as defined in claim 1 wherein said conductive layer overlies substantially all of said divider network.

3. The microwave antenna as defined in claim 1 and comprising an electrically conductive ground plane underlying said radiator array.

4. The microwave antenna as defined in claim 3 wherein said electrically conductive layer includes edge portions which surround at least a portion of each via.

5. The microwave antenna as defined in claim 4 wherein said ground plane includes edge portions which surround at least a portion of each via.

6. The microwave antenna as defined in claim 5 and comprising a plurality of second vias extending through said substrate which interconnect said edge portions of said conductive layer and said ground plane together.

* * * * *